US007097084B2

(12) United States Patent
Ho

(10) Patent No.: US 7,097,084 B2
(45) Date of Patent: Aug. 29, 2006

(54) ADJUSTABLE DEVICE FOR ADJUSTING SAFETY DEVICE OF POWER NAILERS

(75) Inventor: Arthur Ho, Ta-Li (TW)

(73) Assignee: Apach Industrial Co., Ltd., Taichung Hsien (TW)

( * ) Notice: Subject to any disclaimer, the term of this patent is extended or adjusted under 35 U.S.C. 154(b) by 7 days.

(21) Appl. No.: 11/004,958

(22) Filed: Dec. 7, 2004

(65) Prior Publication Data

US 2006/0118591 A1 Jun. 8, 2006

(51) Int. Cl.
*B25C 1/08* (2006.01)

(52) U.S. Cl. ..... 227/8; 227/142

(58) Field of Classification Search ..... 227/8, 227/142

See application file for complete search history.

(56) References Cited

U.S. PATENT DOCUMENTS 5,219,110 A * 6/1993 Mukoyama ..... 227/8
5,261,587 A * 11/1993 Robinson ..... 227/8
5,385,286 A * 1/1995 Johnson, Jr. ..... 227/8
5,579,977 A * 12/1996 Yang ..... 227/142
5,715,982 A * 2/1998 Adachi ..... 227/8
6,012,622 A * 1/2000 Weinger et al. ..... 227/8
6,024,267 A * 2/2000 Chen ..... 227/8
6,170,729 B1 * 1/2001 Lin ..... 227/8
6,427,896 B1 * 8/2002 Ho et al. ..... 227/142
6,581,815 B1 * 6/2003 Ho et al. ..... 227/142
6,929,165 B1 * 8/2005 Chen et al. ..... 227/8

* cited by examiner

*Primary Examiner*—Rinaldi I. Rada
*Assistant Examiner*—Brian Nash
(74) *Attorney, Agent, or Firm*—Rosenberg, Klein & Lee

(57) ABSTRACT

An adjusting device for a power nailer includes a connection member connected to the barrel of the nailer and the trigger and an adjusting bolt are respectively connected thereto. The adjusting bolt is threadedly connected to the connection member and an end of the adjusting bolt is connected to a movable member which is connected to an end of a link of a safety device. A retaining member such as a torsion spring is connected between the movable member and the link. By rotating the adjusting bolt, the link is adjusted a distance to the nose of the nailer. The retaining member allows different types of the links and the movable members to be connected each other.

10 Claims, 5 Drawing Sheets

ADJUSTABLE DEVICE FOR ADJUSTING SAFETY DEVICE OF POWER NAILERS

FIELD OF THE INVENTION

The present invention relates to an adjustable device for adjusting safety device and the adjustable device is located close to the trigger and is conveniently operated by the hand holding the power nailer.

BACKGROUND OF THE INVENTION

Conventional power nailers or staplers as disclosed in U.S. Pat. No. 6,170,729, U.S. Pat. No. 6,427,896 and publication number 2003/0019901 include a safety device and an adjustable device installed close to the nose of the nailer. However, it is experienced that the safety device is composed of a plurality of links and the adjustable device is located at the middle portion of the safety device, so that the links shake when operating the adjustable device. The adjustment cannot be precisely completed due to the shaking. Besides, the adjustable device is located away from the handle or the trigger so that the user has to use one hand to hold the handle and operate the trigger, and the other hand to operate the adjustable device. Furthermore, the adjustable device and the safety device are secured correspondingly so that different safety devices or adjustable device cannot be replaced.

The present invention intends to provide an adjustable device that is located close to the trigger and connected to the safety device by a retaining member which allows different types of safety devices or adjustable devices to be connected with each other.

SUMMARY OF THE INVENTION

The present invention relates to an adjustable device for adjusting a safety device of a power nailer and the adjustable device is located beside the trigger so that the user can easily access the adjustable device. The adjustable device comprises an adjustable assembly and a movable assembly located between the link of the safety device and the trigger. The adjustable assembly has a connection member connected to a barrel of the nailer and the trigger is pivotably connected to the connection member. An adjusting bolt includes a shank at one end for threadedly connected to the connection member and a protrusion extends from the other end which is connected to the link. The link is adjusted by rotating the adjusting bolt.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
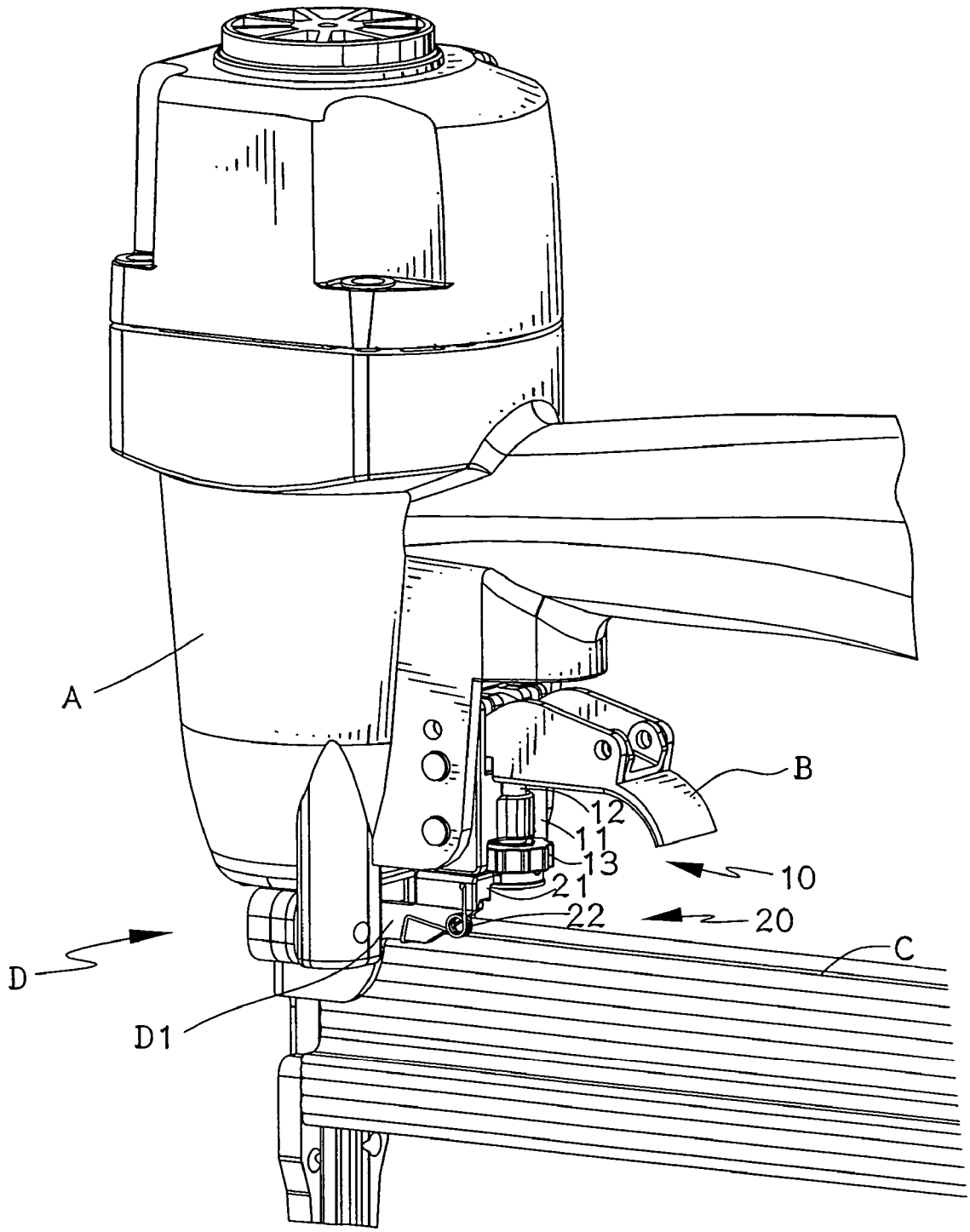
FIG. 1 is a perspective view to show the power nailer with the adjustable device of the present invention.
Figure 2:
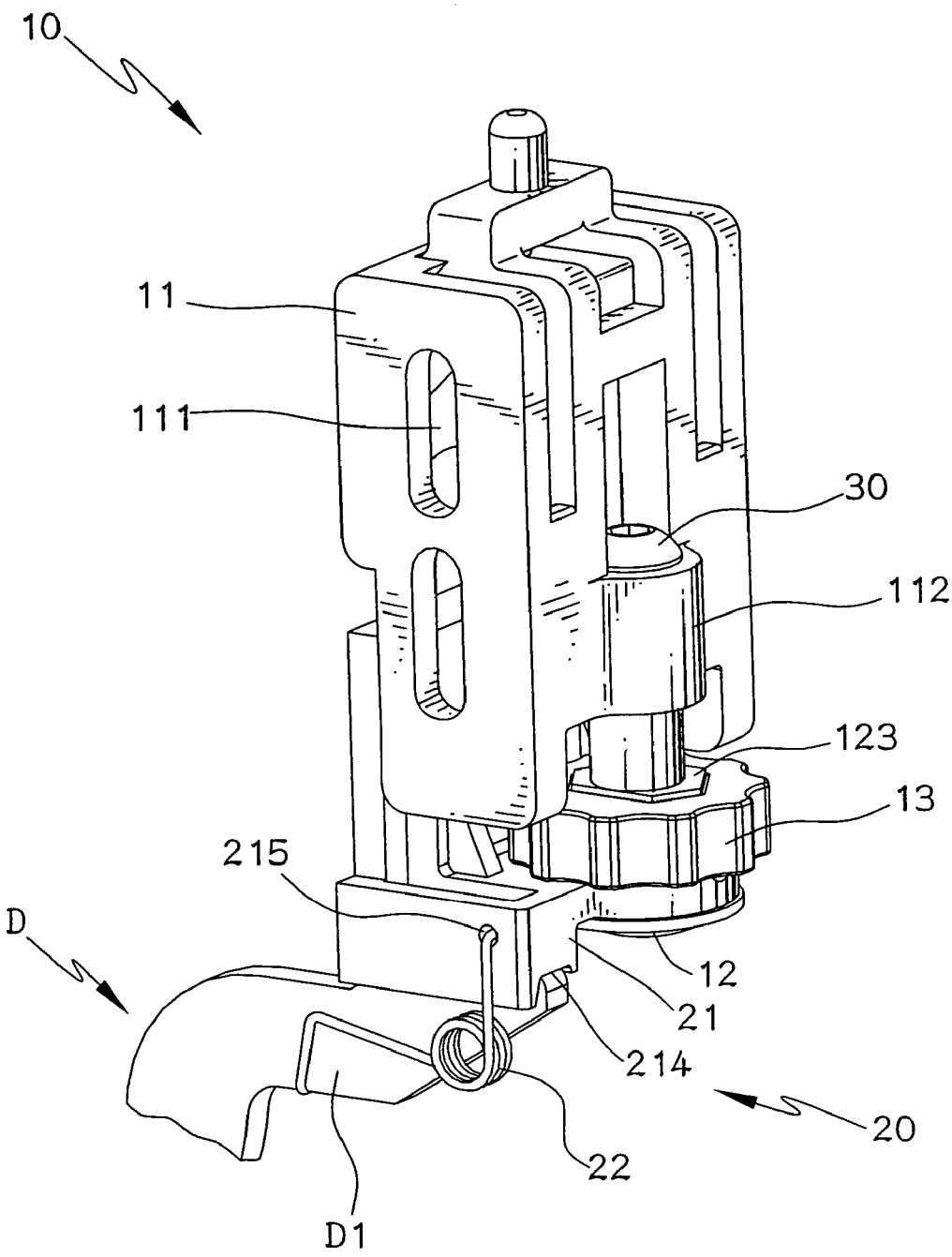
FIG. 2 shows the combination of the adjustable device of the present invention and the link.
Figure 3:
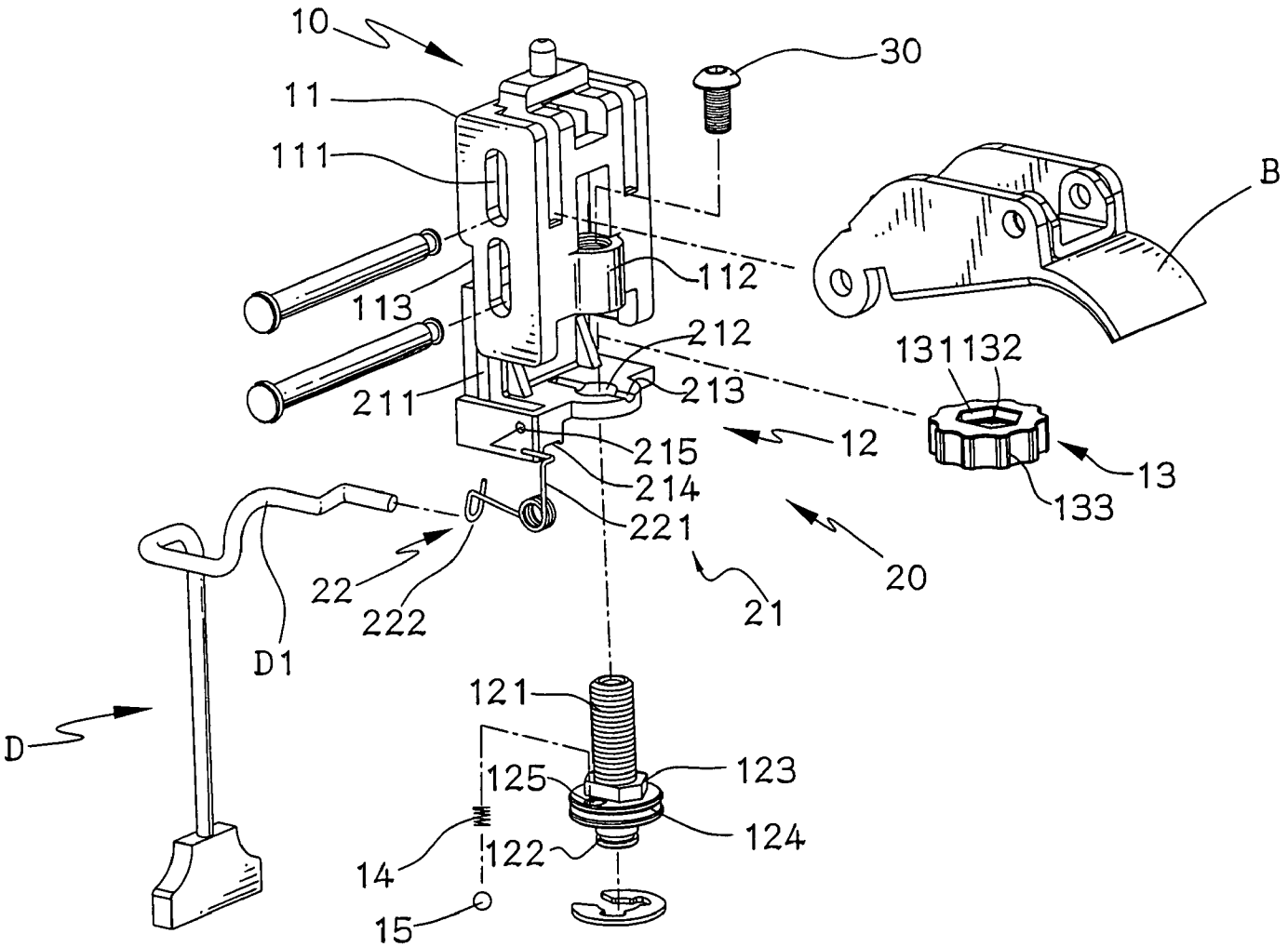
FIG. 3 is an exploded view to show the adjustable device of the present invention and the trigger.
Figure 4:
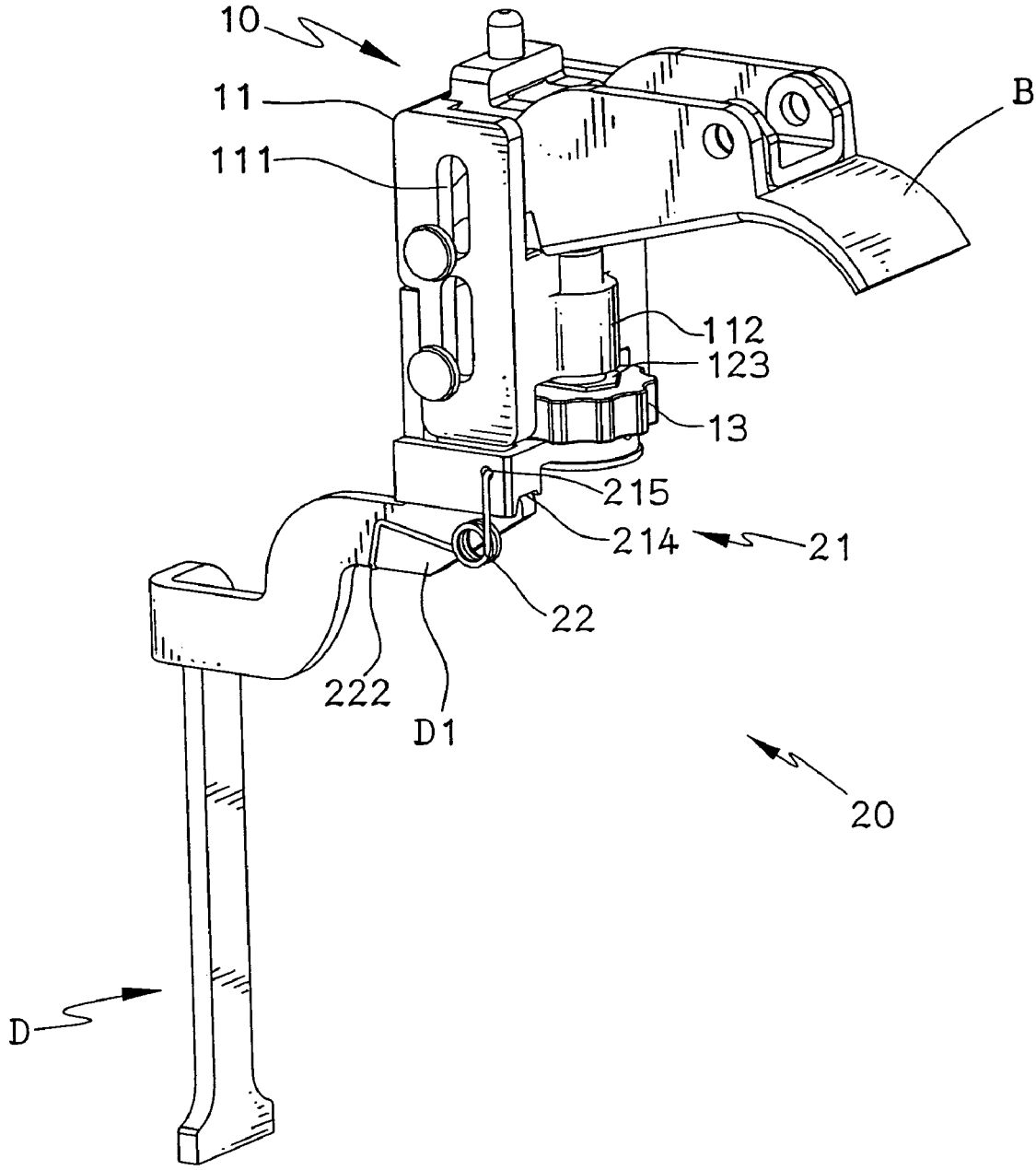
FIG. 4 shows the trigger is connected to the connection member and the link is connected to the movable member by a retaining member.
Figure 5:
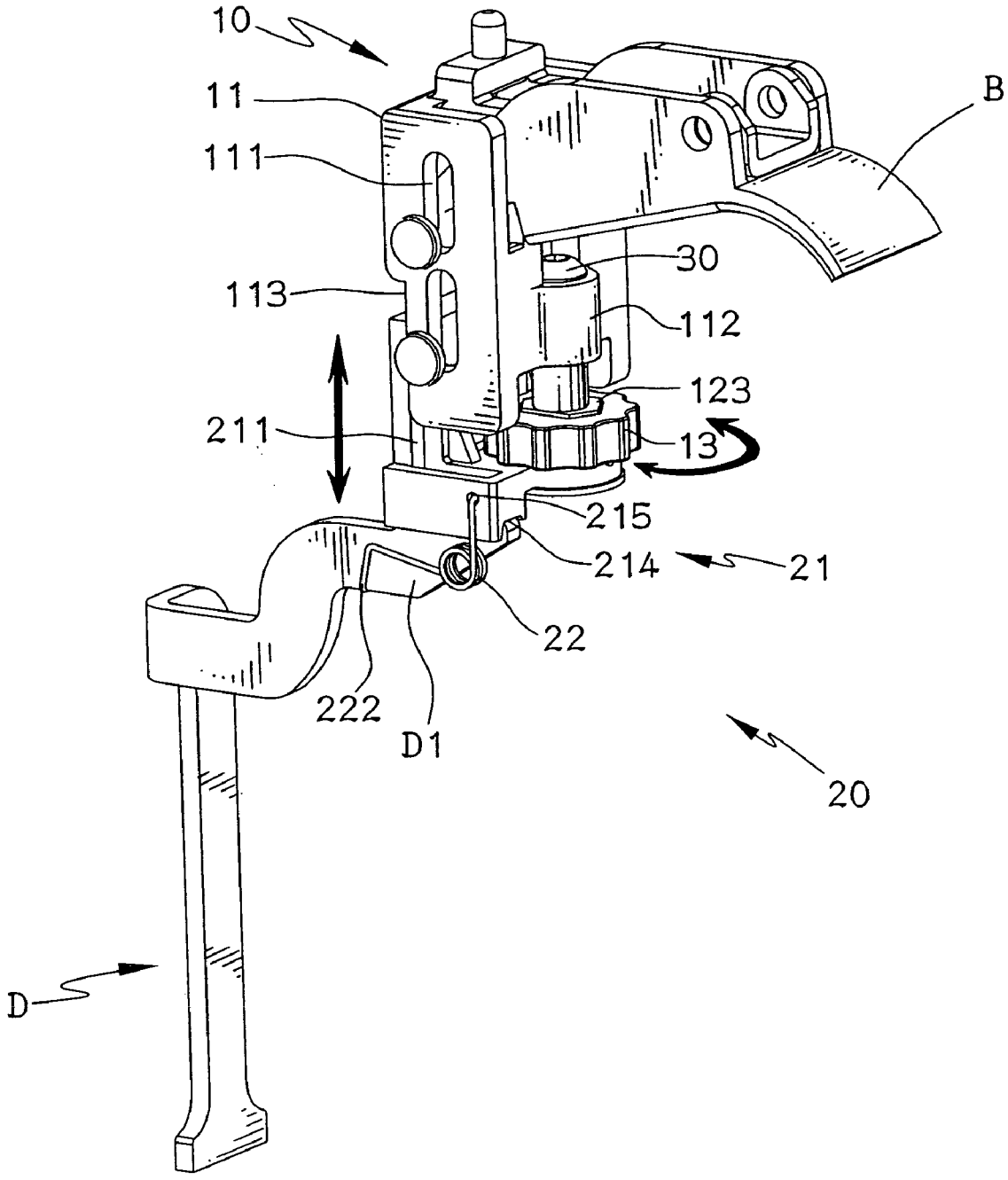
FIG. 5 shows the link is adjusted by rotating the adjusting bolt.

Referring to FIGS. 1 to 5, a power nailer or stapler generally includes a barrel "A" with a handle and a nose is connected the front end of the barrel "A". A magazine "C" is connected to the nose so as to provide nails or staples into the nose. When a user holds the handle and pulls the trigger "B", one nail or staple is ejected out from the nose. A safety device "D" includes a link "D1" which has one end operationally connected to the trigger "B" and the other end of the link D1 extends to the nose.

The adjustable device for adjusting the safety device "D" comprises a connection member 11 which has at least one connection portions 111 for being connected with the barrel "A" of the nailer and the trigger "B" includes two lugs which are pivotably received in two slits in the connection member 11. A threaded portion 112 is located at a first side of the connection member and an engaging recess 113 is located at a second side of the connection member 11. In this embodiment, the connection portions 111 of the connection member 11 are two elongate holes. The threaded portion 112 of the connection member 11 has an inner threaded periphery with which a shank 121 of an adjusting bolt 12 is engaged. The adjusting bolt 12 has the shank 121 on one end thereof and a protrusion 122 on the other end which is connected to the link "D1". The shank 121 of the adjusting bolt 12 includes an outer threaded periphery for being connected to the inner threaded periphery of the threaded portion 112, and an inner threaded periphery with which an adjusting screw 30 is threadedly connected. The adjusting screw 30 controls the position of the adjusting bolt 12 relative to the connection member 11 and prevents the adjusting bolt 12 from dropping from the threaded portion 112. A first engaging portion 123 and a second engaging portion 124 are connected to the adjusting bolt 12 and located between the shank 121 and the protrusion 122. The second engaging portion 124 has a reception hole 125 for receiving a spring 14 and a bead 15 therein.

An operation member 13 is connected to the adjusting bolt 12 and located between the shank 121 and the protrusion 122. The operation member 13 includes a third engaging portion 131 and a fourth engaging portion 132 defined in an inner periphery of a through hole thereof. A polygonal outer periphery 133 is defined in an outer periphery of the operation member 13 so that the user may easily rotate the operation member 13. The third engaging portion 131 of the operation member 13 is engaged with the first engaging portion 123 of the adjusting bolt 12 and the fourth engaging portion 132 of the operation member 13 is engaged with the second engaging portion 124 of the adjusting bolt 12.

The movable assembly 20 has a movable member 21 and a retaining member 22. The movable member 21 has a guide portion 211 on one end thereof and an urging portion 214 defined in the other end of the movable member 21. The guiding portion 211 is engaged with the engaging recess 113 of the connection member 11 and a hole 215 is located beside the urging portion 214. The retaining member 22 has one end engaged with the hole 215 of the movable member 21 and the other end of the retaining member 22 has a support portion 222 which is connected with the link "D1". The urging portion 214 is a notch so as to engage with the link "D1".

The movable member 21 has a through hole 212 defined in the end opposite to the guide portion 211 and a notch 213 is defined in a surface enclosing the through hole 212 so as to receive the bead 15. That is to say, when rotating the operation member 13, the user is acknowledged the number of revolution that the operation member 13 is rotated.

The operation member 13 is located in front of the trigger "B" so that the user can easily access it by the same hand operating the trigger "B". The adjustable assembly 10 is connected to an end of the link "D1" which has a complete structure without any interruption so that the shaking of the safety device of the conventional nailers is eliminated. The retaining member 22 allows different types of safety devices or adjustable devices to be connected with each other.

While we have shown and described the embodiment in accordance with the present invention, it should be clear to those skilled in the art that further embodiments may be made without departing from the scope of the present invention.

What is claimed is:

1. An adjustable device for adjusting a safety device of a power nailer, the safety device includes a link, the adjustable device comprising:

an adjustable assembly mechanically coupled by a connection member thereof respectively to a barrel and a trigger of the nailer, the connection member including a threaded portion below the trigger, the threaded portion having an inner threaded periphery;

a movable assembly mechanically coupled to the link and slidably engaged with the adjustable assembly, the movable assembly having a through hole aligned with the threaded portion of the connection member; and an adjusting bolt having a shank on one end thereof and a protrusion on the other end, the shank having threads formed on its outer periphery, the protrusion being connected to the link, wherein the adjusting bolt is inserted through the through hole of the movable assembly and is threadedly engaged with the threaded portion of the connection member.

2. The device as claimed in claim 1, wherein the connection member has disposed thereon two pairs of opposing elongate holes.

3. The device as claimed in claim 1, wherein the shank of the adjusting bolt includes an inner threaded periphery, an adjusting screw is threadedly connected to the inner threaded periphery of the shank.

4. The device as claimed in claim 1, wherein an operation member is connected to the adjusting bolt and located between the shank and the protrusion.

5. The device as claimed in claim 4, wherein a first engaging portion and a second engaging portion are formed on the adjusting bolt between the shank and the protrusion, the operation member being engaged with the first engaging portion and the second engaging portion.

6. The device as claimed in claim 5, wherein the operation member is engaged to the first engaging portion and the second engaging portion respectively by a third engaging portion and a fourth engaging portion defining a through hole thereof, the operation member including a polygonal outer periphery an outer periphery of the operation member.

7. The device as claimed in claim 6, wherein the third engaging portion is engaged with the first engaging portion and the fourth engaging portion is engaged with the second engaging portion.

8. An adjustable device for adjusting a safety device of a power nailer, the safety device includes a link, the adjustable device comprising:

an adjustable assembly mechanically coupled by a connection member respectively to a barrel and a trigger of the nailer, the connection member including a threaded portion below the trigger, the threaded portion having an inner threaded periphery;

a movable assembly having a guide portion in substantial perpendicularity with an urging portion formed in the movable assembly, the guiding portion engaged with the adjustable assembly, a hole being formed in the movable assembly on a side thereof perpendicular to the urging portion, the movable assembly having a through hole adjacent the urging portion;

a retaining member having one end engaged with the hole of the movable member and the other end of the retaining member having a support portion mechanically coupled to the link; and an adjusting bolt inserted through the through hole in the movable assembly and is threadedly engaged with the threaded portion of the movable assembly.

9. The device as claimed in claim 8, wherein the urging portion is a notch.

10. An adjustable device for adjusting a safety device of a power nailer comprising:

an adjustable assembly and a movable assembly, the adjustable assembly having a connection member, an adjusting bolt and an operation member, the movable assembly having a movable member and a retaining member, the connection member having two connection portions for connecting the adjustable assembly to a barrel of the nailer, the connection member having a threaded portion located at a first side thereof, an engaging recess located at a second side of the connection member, the adjusting bolt having a shank on one end thereof and a protrusion on the other end, the adjusting bolt having formed thereon a first engaging portion and a second engaging portion between the shank and the protrusion, the second engaging portion having a reception hole for receiving a spring and a bead therein, the operation member including a third engaging portion and a fourth engaging portion defined in an inner periphery of a through hole thereof, a polygonal outer periphery defined in an outer periphery of the operation member, the movable member having a guide portion on one end thereof and a through hole defined in the other end of the movable member, a notch defined in a surface enclosing the through hole so as to receive the bead, an urging portion located beside the through hole and a hole defined beside the urging portion, the retaining member having one end engaged with the hole of the movable member and the other end of the retaining member having a support portion which is adapted to be connected with a link of the safety device.

* * * * *